US006305457B1

(12) United States Patent
Leivenzon et al.

(10) Patent No.: US 6,305,457 B1
(45) **Date of Patent: *Oct. 23, 2001**

+

(54) DISENGAGEABLE ROLLING DOOR DRIVE

(75) Inventors: Jack Leivenzon; Simon Leivenzon, both of Highett (AU)

(73) Assignee: Automatic Technology Australia Pty. Ltd., Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/516,713

(22) Filed: Mar. 1, 2000

Related U.S. Application Data

(63) Continuation-in-part of application No. 09/091,667, filed as application No. PCT/AU96/00821 on Dec. 20, 1996, now Pat. No. 6,116,324.

(30) Foreign Application Priority Data

Dec. 21, 1995 (AU) ..... 7245/95
Dec. 21, 1995 (AU) ..... 7246/95

(51) Int. Cl.[7] ..... E06B 9/11
(52) U.S. Cl. ..... 160/310; 160/1
(58) Field of Search ..... 160/310, 311, 160/188, 133, 1, 7, 9, 2; 74/625, 405

(56) References Cited

U.S. PATENT DOCUMENTS

| | | | | |
|---|---|---|---|---|
| 2,819,628 | | 1/1958 | Wardlaw . | |
| 3,134,273 | | 5/1964 | Wardlaw . | |
| 4,342,354 | * | 8/1982 | Leivenzon et al. | 160/310 X |
| 4,392,392 | * | 7/1983 | Perisic et al. | 160/310 X |
| 4,472,940 | | 9/1984 | Kubota . | |
| 4,706,727 | * | 11/1987 | Leivenzon et al. | 160/310 X |
| 4,721,146 | * | 1/1988 | Wardlaw | 160/310 |
| 4,782,887 | * | 11/1988 | Jones et al. | 160/310 |
| 4,844,140 | * | 7/1989 | Jones et al. | 160/310 |
| 5,839,555 | * | 11/1998 | Hsieh | 160/310 X |
| 6,116,324 | * | 9/2000 | Leivenzon et al. | 160/310 |

FOREIGN PATENT DOCUMENTS

| | | |
|---|---|---|
| 30718/77 | 5/1979 | (AU) . |
| 601194 | 4/1948 | (GB) . |
| 2189565 | 10/1997 | (GB) . |
| WO 88/04716 | 6/1988 | (WO) . |

* cited by examiner

*Primary Examiner*—David M. Purol
(74) *Attorney, Agent, or Firm*—Reed Smith LLP

(57) ABSTRACT

A rolling door drive assembly including a final drive unit for connection to a door, whereby the door may be rotated by the final drive unit about an axis to open and close the door, a motor, a drive between the final drive unit and the motor operatively engaged with the motor, one or more drive axes about which one or more components of the drive rotate to transfer drive from the motor to the final drive unit, an actuator to bring the drive to a first configuration at which the motor is engaged to drive the final drive unit through the drive and to bring the drive to a second configuration at which the motor is disengaged from driving the final drive unit, and a resilient spring for urging the drive into one of the configurations. The actuator includes a cam rotatable about a cam axis separate from the one or more drive axes. The cam acts to set the desired configuration of the drive.

16 Claims, 10 Drawing Sheets

A - A

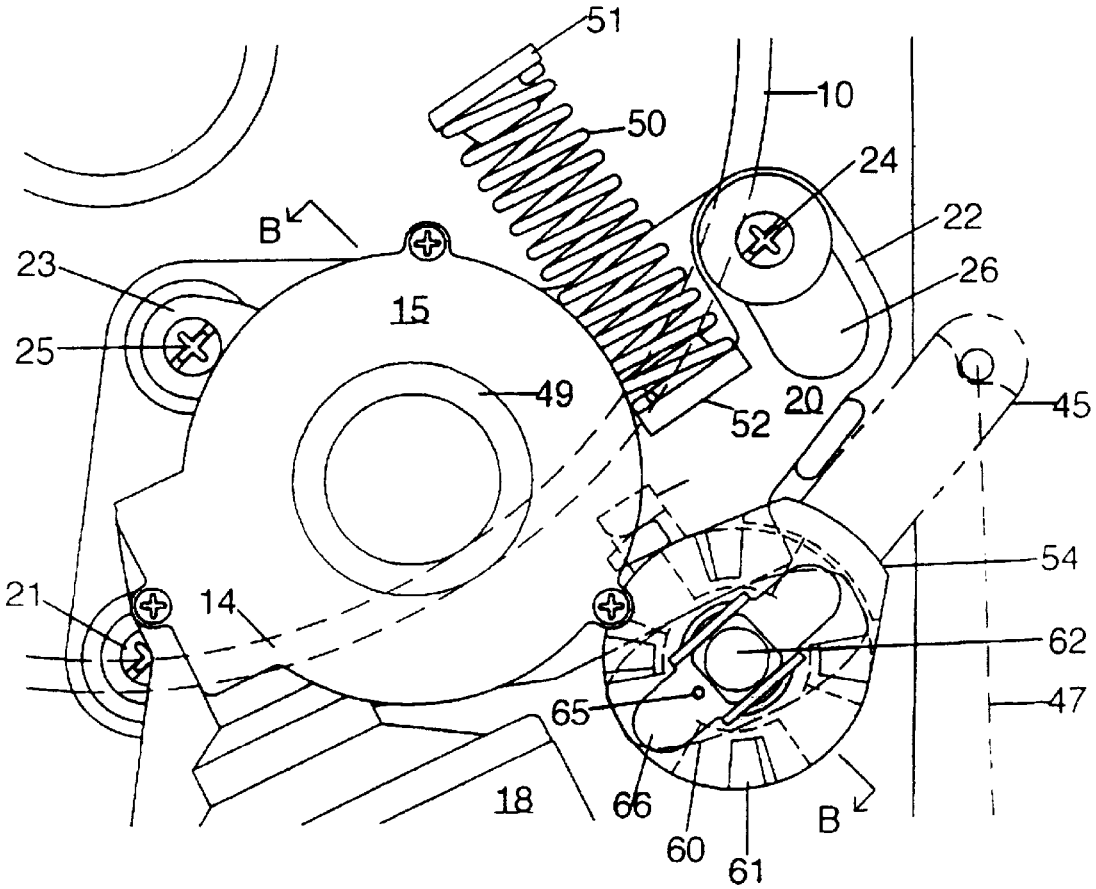
Fig 7
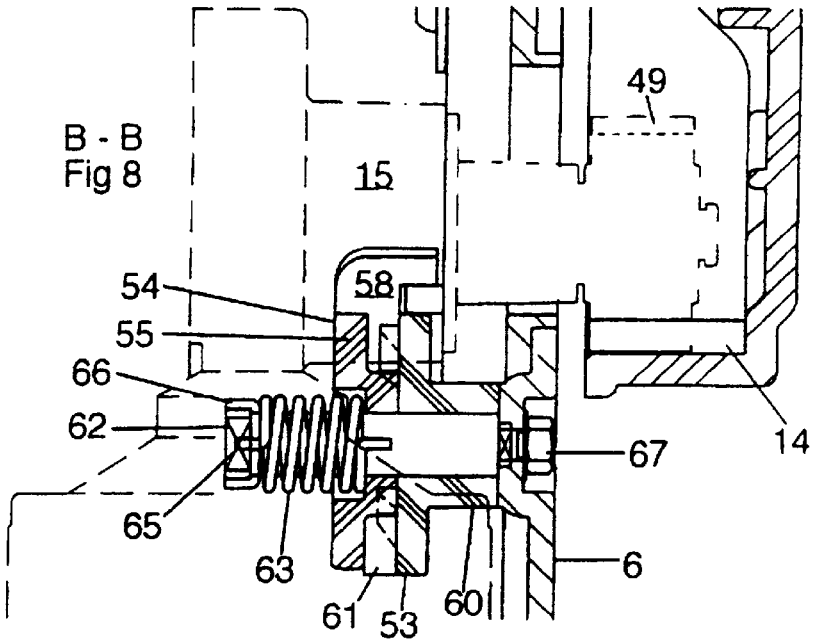

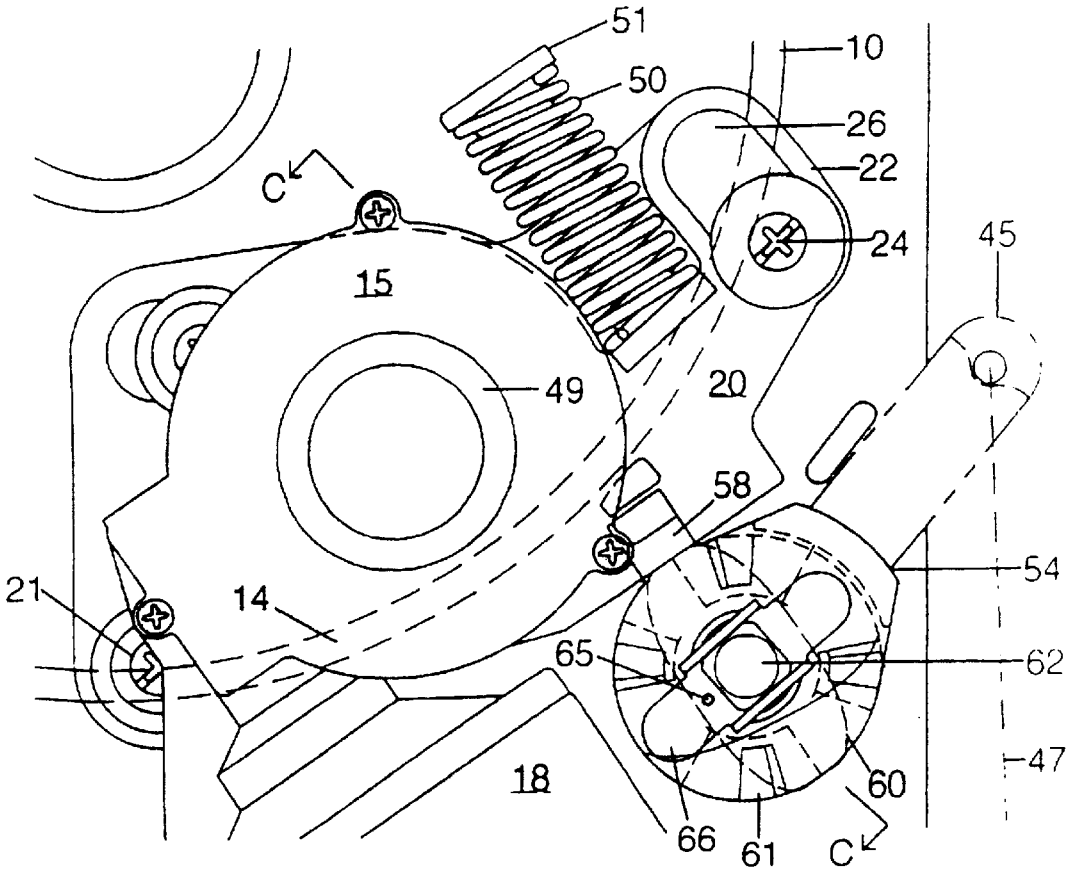
Fig 9
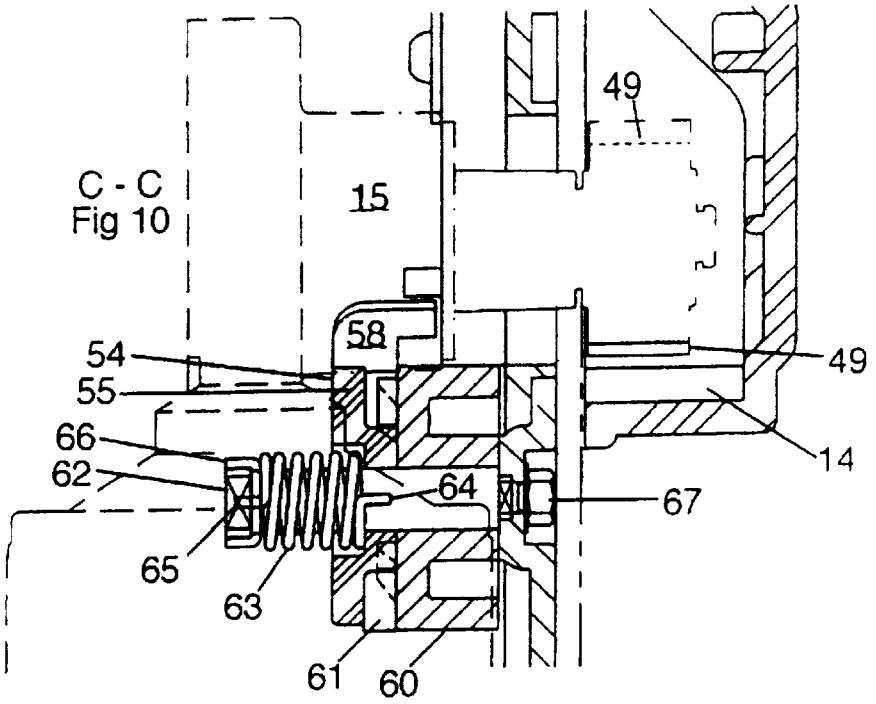

DISENGAGEABLE ROLLING DOOR DRIVE

This application is Continuation-in-Part of U.S. patent application Ser. No. 09/091,667 filed on Jun. 18, 1998 now U.S. Pat. No. 6,116,324 which is a U.S. National Phase application of PCT application Ser. No. PCT/AU96/00821 filed on Dec. 20, 1996.

FIELD OF THE INVENTION

The invention relates to a rolling door drive and mounting assembly.

BACKGROUND OF THE INVENTION

Rolling door drive assemblies are well known and typically have a chassis which supports a motor with an associated drive (e.g. a gear). The chassis is usually connected to a final drive unit (e.g. a gear drum having internal teeth) which meshes with the drive. The final drive unit is connected to the rolling door to cause it to move up or down by operation of the motor.

The rolling door is held in position by end supports at both ends which engage a mounting axle passing axially through the rolling door. The rolling door drive assembly is mounted on the axle at one end between the end of the door and the adjacent end support for the axle.

A typical example of such rolling door assemblies is disclosed in Australian Patent number 558906. These assemblies are predominantly mechanical and require regular servicing. To achieve this it is necessary to either remove or at least disengage the rolling door from the axle support. Accordingly there has been a well defined need to develop assemblies which may be readily accessible or easily removed from the door.

A similar need has been defined in the retrofit market in which the assembly is totally replaced by a new or reconditioned assembly.

Likewise as the door opening is usually situated very close to defining side walls of a shed or garage there has been a need to have slim line assemblies which may be fitted between the opening and those walls.

One prior attempt to meet one or more of these needs is the drive assembly disclosed in Australian Patent number 601414. This relates to the general type of assembly which has a chassis and a final drive unit rotatably mounted to the chassis about an axis of rotation for driving connection to a door for rolling the door about a door mounting axle. The assembly has a motor fixed relative to the chassis which can drive the final drive unit.

More particularly this prior assembly has a housing for a part of the drive assembly which has a recessed channel adapted to receive a mounting bracket. In this way the mounting bracket connection to the assembly occurs in the recess which minimizes the width of the installed assembly. The housing assembly of this is a complicated design which must be specially manufactured. While it does allow the assembly to fit very closely against the mounting bracket, it still does not facilitate easy servicing. To remove the housing the assembly must be first disengaged from the door axle which is a difficult and time consuming job, especially where space between the assembly and the side wall is restricted.

Even if the space is not restricted, the housing cannot be disengaged from the assembly without movement of the entire assembly. This means that the access for servicing is still restricted. As shown in the drawings of this patent, the motor is located in the housing above the axis of rotation. This further causes the maintenance to be complicated as the motor is virtually on the extreme of the area to be reached by a technician.

This patent also discloses a clutch interposed in the drive train which permits the fixed motor to be engaged and disengaged. An exterior handle directly connects to and operates the clutch so that when the drive train is engaged the motor will drive the rolling or unrolling of the door. The dutch would normally only be used when manual operation of the door is desired. In this instance the motor is disengaged. To re-engage the motor the clutch is used to manually engage the drive train.

A further example of an assembly of this type is Australian Patent number 519424. In this assembly the motor is also located at the upper extremity of the assembly, making maintenance difficult. In this patent, the motor is mounted on a frame which allows it to be disengaged from the drive train. The handle removes the pawl from the teeth and the motor can drop down. To re-engage the motor, it needs to be manually lifted and the pawl re-engaged in the teeth.

Another approach is disclosed in an assembly sold under the trade marks Merlin and Parker in Australia. This assembly has an externally toothed final drive unit which is attached to a chassis. The chassis has a hub which can be located on a door mounting axle and an arm extending down from the hub. The arm is removably connected via two vertically orientated bolts and a horizontal location bolt, to a lower support which carries a motor and circuitry etc. To remove the support from the arm, the location bolt needs to be loosened and the vertical bolts removed. The disengaging movement is initially traverse to the door mounting axle to clear the location bolt and then downward.

It is thought that this assembly, by requiting transverse movement, restricts its applicaton in confined areas as such movement may contact an adjacent wall. Also, as the connection between the support and the hub is spaced by an arm, a twisting moment is imposed upon the arm and hence the hub, when the motor on the support is operated to rotate the final drive unit. Accordingly, the arm needs significant reinforcement to compensate for this twisting moment.

OBJECT OF THE INVENTION

It is an object of the invention to provide an assembly which ameliorates one or more of the above difficulties.

SUMMARY OF THE INVENTION

Accordingly, there is provided a rolling door drive assembly including:

(i) a final drive unit for connection to a door, whereby the door may be rotated by the final drive unit about an axis to open and close the door, (ii) a motor, (iii) drive means between the final drive unit and the motor operatively engaged with the motor, (iv) one or more drive axes about which one or more components of the drive means rotate to transfer drive from the motor to the final drive unit, (v) actuation means to bring the drive means to a first configuration at which the motor is engaged to drive the final drive unit through the drive means and to bring the drive means to a second configuration at which the motor is disengaged from driving the final drive unit, and (vi) resilient means for urging the drive means into one of the configurations wherein the actuation means includes a cam rotatable about a cam axis separate from the one or more drive axes, the cam acting to set the desired configuration of drive means.

The motor and drive means may be mounted on a frame which is pivotally attached to the chassis.

The actuation means may comprise:

(i) a cam rotatable about a central axis;

(ii) a wheel fixed for rotation with the cam;

(iii) a pawl fixed for rotation about the central axis and selectively engaging the wheel;

(iv) means to rotate the pawl; and (v) resilient means to bias the motor and drive means towards the cam.

The pawl may be fixed for reciprocal rotational movement through a predetermined arcuate distance to cause the cam to move. As such the pawl may be operated remotely by a cord. One pull and release will move the drive means into engagement with the final drive unit. Another pull and release will disengage the drive means from the final drive unit. Equally possible is to have the remote operation of the actuation means controlled by well known electrical means.

In another preferred embodiment of the invention the chassis has a first section having a clamp means for receiving a mounting axle and a second section detachable from the first section.

As the second section is detachable from the first section, it is possible to remove the second section and any element mounted on it, eg. motor and/or circuitry.

In another preferred embodiment of the invention the clamp means has fixing means to locate the first section in a predetermined position on the mounting axle. Typically the fixing means is at least two location bolts which are threadingly engaged with the clamp means. By turning these bolts, their ends come into functional contact with the mounting axle and fix the assembly is in the operative position.

In another particular non limiting embodiment of the invention the assembly further comprises a housing which encloses at least part of assembly. The housing may be removably and temporarily held in position by clips. Accordingly if part of the drive assembly requires repair or inspection, the housing adjacent that part of the assembly may be removed or displaced to permit easy access for those purposes. Separate housings may be provided for each section of the chassis.

In a further embodiment of the invention the assembly further comprises electrical control means to control the operation of the motor.

In yet another embodiment of the invention the chassis comprises a third section connected to but detachable from the second section. Accordingly this third section may carry elements of the assembly which may require separate attention. For example lights to indicate the operation of the drive, sensors to permit operation of the assembly to be remotely controlled. Preferably the third section has an associated housing to protect the enclosed element of the assembly or provide for transmission of signals.

Accordingly to a second form of the invention the invention may include a rolling door drive and mounting assembly including:

(i) a chassis;

(ii) a final drive unit mounted to the chassis for rotation about an axis of rotation for driven connection to a door;

(iii) a motor attached to the chassis; and (iv) drive means interconnecting the motor and final drive unit;

wherein the chassis has a first section having a clamp means for receiving a mounting axle and a second section detachable from the first section adjacent the clamp means.

As the sections can be engaged and disengaged adjacent the clamp means, all primary connections of the two sections occur in a single area avoiding the need for connecting arms. Similarly, this allows other elements, such as the motor, to be positioned on the second section adjacent the clamp means. The arrangement is more compact and permits the use a gear drum type final drive which can be engaged on its inner toothed surface by the outlet of the motor.

In a particular aspect of the second form of the invention, the final drive unit comprises a gear drum mounted to the chassis for rotation about an axis of rotation for driven connection to a door for tolling the door about a door mounting axle and the drive means interconnects the motor and gear drum.

The second section may be detachable from the first section without transverse movement. More preferably, the second section detachable from the first section by downward movement, and most preferably by a combination of axial and downward movement.

As the mounting assemblies are usually located in restricted areas, any transverse movement of the second section when being disengaged from the first section may encounter a wall.

The features described above with respect to the first form of the invention may be used with the second form of the invention and vice versa.

It will be appreciated that an advantage of the first form of the invention is the ability of the drive train to be engaged and disengaged remotely without the use of clutches and or handles configured in the specific arrangements described herein under the heading "Background of the invention".

It will be appreciated that the second form of the invention relates to the detachability of part of the chassis from the part which has the clamping means for the mounting axle. As it is detachable, it permits the elements supported on it to be removed downwardly from the assembly without the need to disturb the entire door assembly. This in turn permits these elements to be repaired or replaced. Consequently significant time and money is saved.

DESCRIPTION OF THE DRAWINGS

In the drawings the elements are given numbers.

The various forms of the invention will now be further described with reference to the accompanying drawings in which:

FIG. 7 is an exploded view of the cam ratchet assembly of FIG. 5 in the engaged gear position.

FIG. 8 is a cross-sectional view of FIG. 7 along the B—B line.

FIG. 9 is an exploded view of the cam ratchet assembly of FIG. 5 in the disengaged gear position.

FIG. 10 is a cross-sectional view of FIG. 7 along the C—C line.

DETAILED DESCRIPTION OF THE INVENTION

Figure 1:
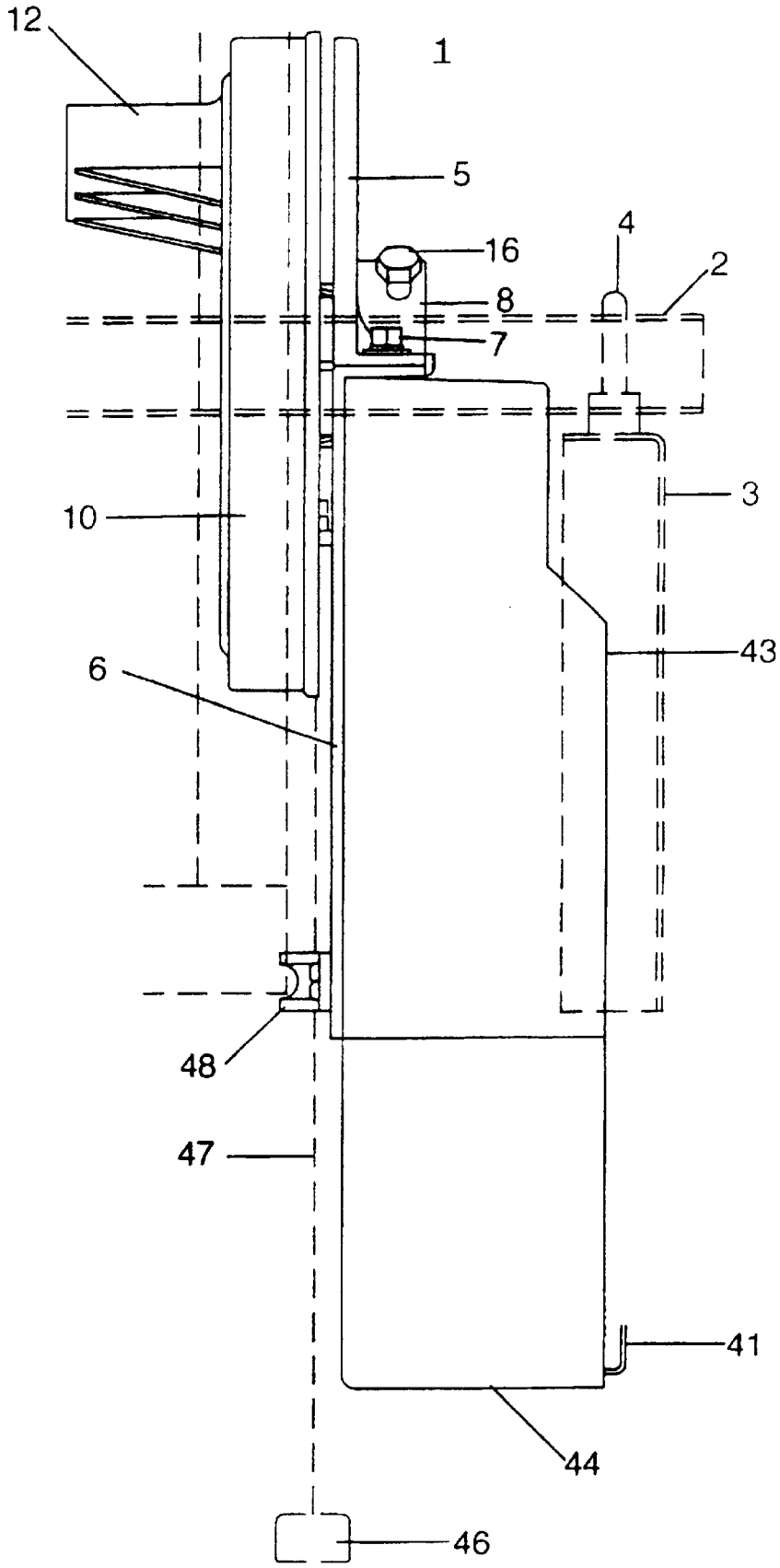
FIG. 1 is a side view of a rolling door drive and mounting assembly according to the invention.
Figure 2:
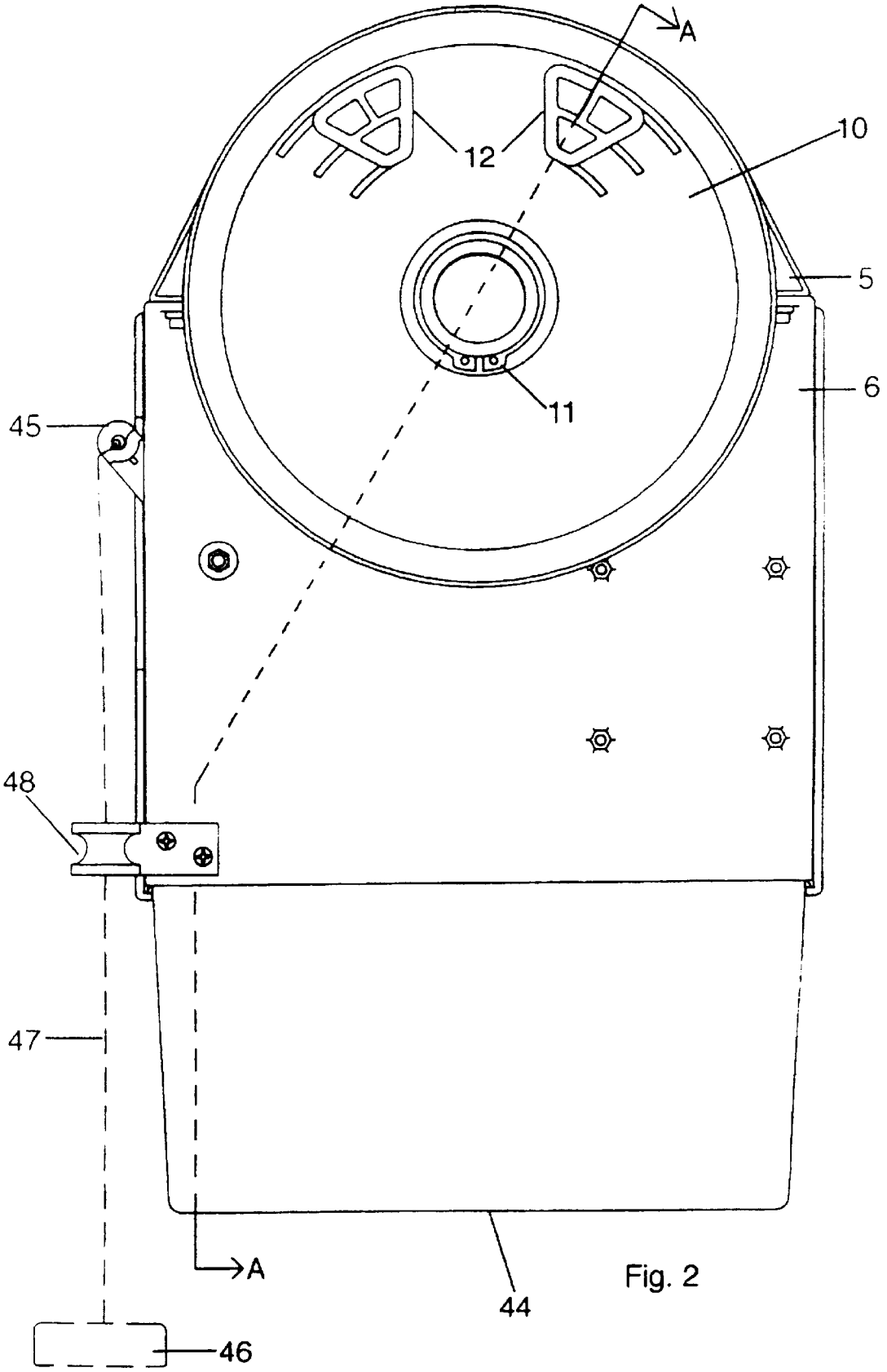
FIG. 2 is a front view of the assembly of FIG. 1.
Figure 3:
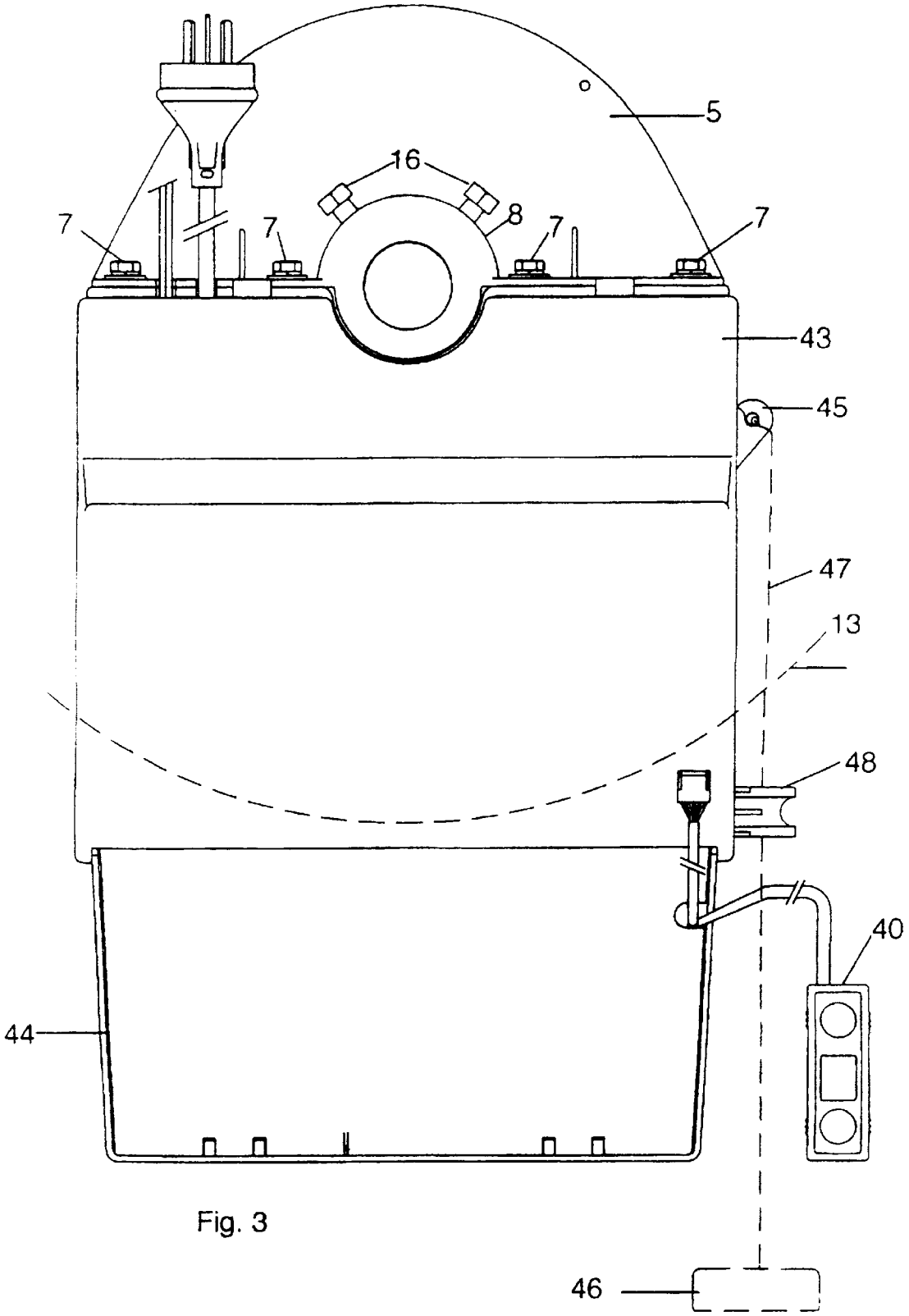
FIG. 3 is a rear view of the assembly of FIG. 1.

Referring to the drawings (in particular FIGS. 1 to 3), drive assembly 1 is mounted on mounting axle 2 which in turn is connected to support bracket 3 with a U-clamp 4. The U-clamp 4 is inverted and encircles mounting axle 2. It has ends (not shown) which pass through openings in support bracket 3 and are secured by nuts (not shown).

Drive assembly 1 comprises a chassis which has a first section 5 and a second section 6. The first section 5 and second section 6 are connected together by nut and bolt sets 7. The first section 5 has a clamp 8 and sleeve 9 which encircle mounting axle 2 (as more particularly shown in FIG. 4).

The assembly 1 further comprises a gear drum 10 which is located on sleeve 9 and retained for rotational movement about sleeve 9 by circlip 11. As such gear drum 10 can rotate about sleeve 9. Gear drum 10 has a pair of fingers 12 projecting from an area adjacent the periphery of gear drum 10. Fingers 12 are destined to engage between spokes of a circular frame (not shown) about which the rolling door 13 rolls or unrolls. On the inside wall of gear drum 10 is a continuous set of longitudinal teeth 14 destined to engage with corresponding teeth of a drive gear 15 (see FIG. 4).

The first section 5 has a pair of locating bolts 16 which are engaged in threads in clamp 8. By turning locating bolts 16 they come into frictional contact with mounting axle 2 (as more particularly shown in FIG. 1). The first section 5 can therefore be located on mounting axle 2 and fixed into a desired position by use of locating bolt 16. As the second section 6 and gear drum 10 are connected to first section 5 they are also positioned indirectly by adjustment of location bolts 16.

The second section 6 is the mounting board for transformer 17, motor 18, drive gear 15 and cam ratchet assembly 19.

Figure 5:
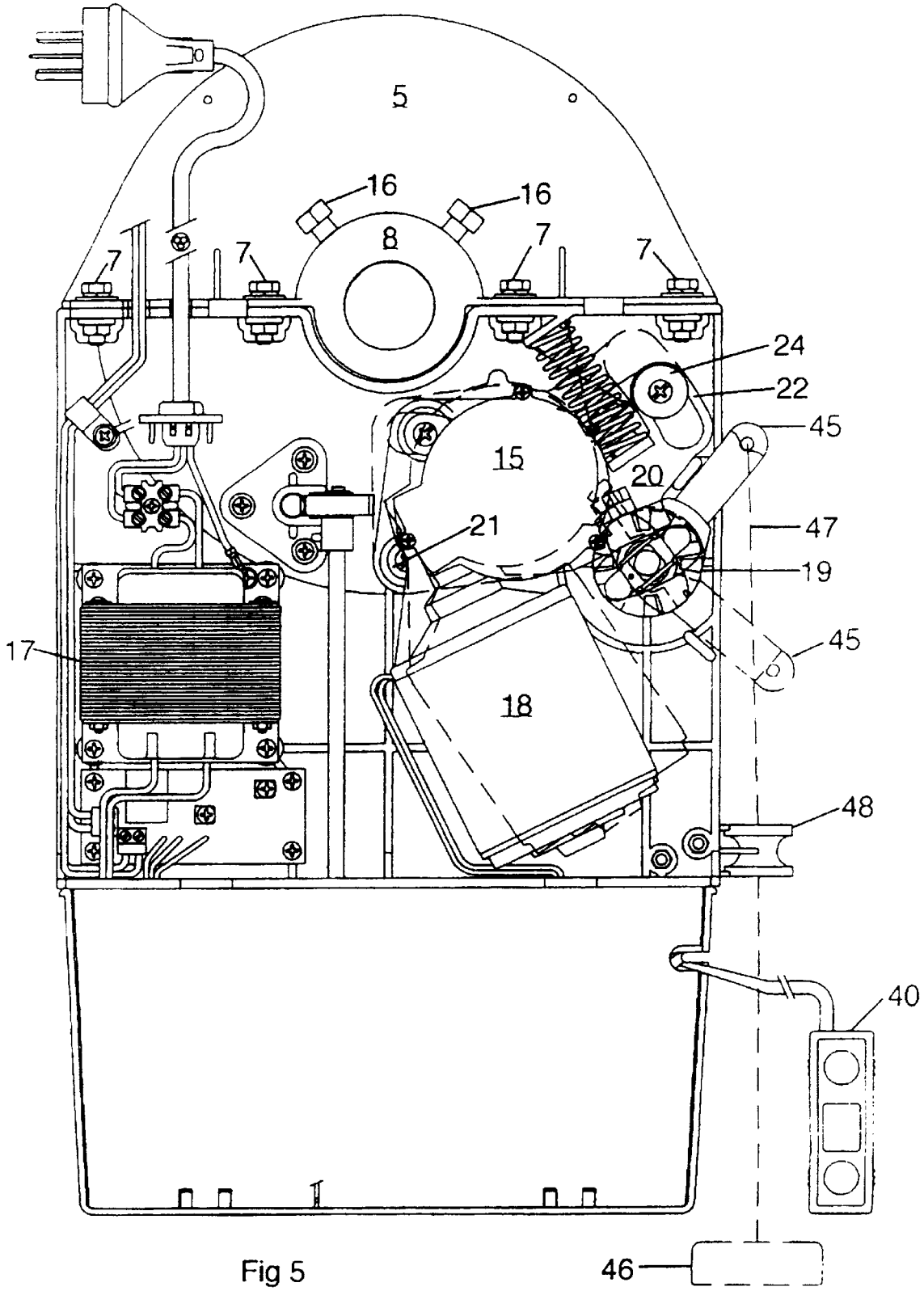
FIG. 5 is a rear view of the assembly of FIG. 1 with the main covet removed.

Drive gear 15 and motor 18 are mounted on a frame 20 (see FIG. 7). The frame 20 is fixed at pivot bolt 21 so that rotation of the frame 20 about pivot bolt 21 causes cog teeth 49 to engage or disengage teeth 14 of gear drum 10. The free ends 22 and 23 are retained by retaining bolts 24 and 25 within slots 26. This movement is controlled by a cam ratchet assembly 19 having lever 45 which is connected to a remote manual operator 46 via a cord 47 passing through a guide 48. As shown in FIG. 5 the lever 45 can be pulled down to an interim position (shown with ghost lines) to cause movement of the frame 20. The cam ratchet assembly 19 will be explained later.

Figure 6:
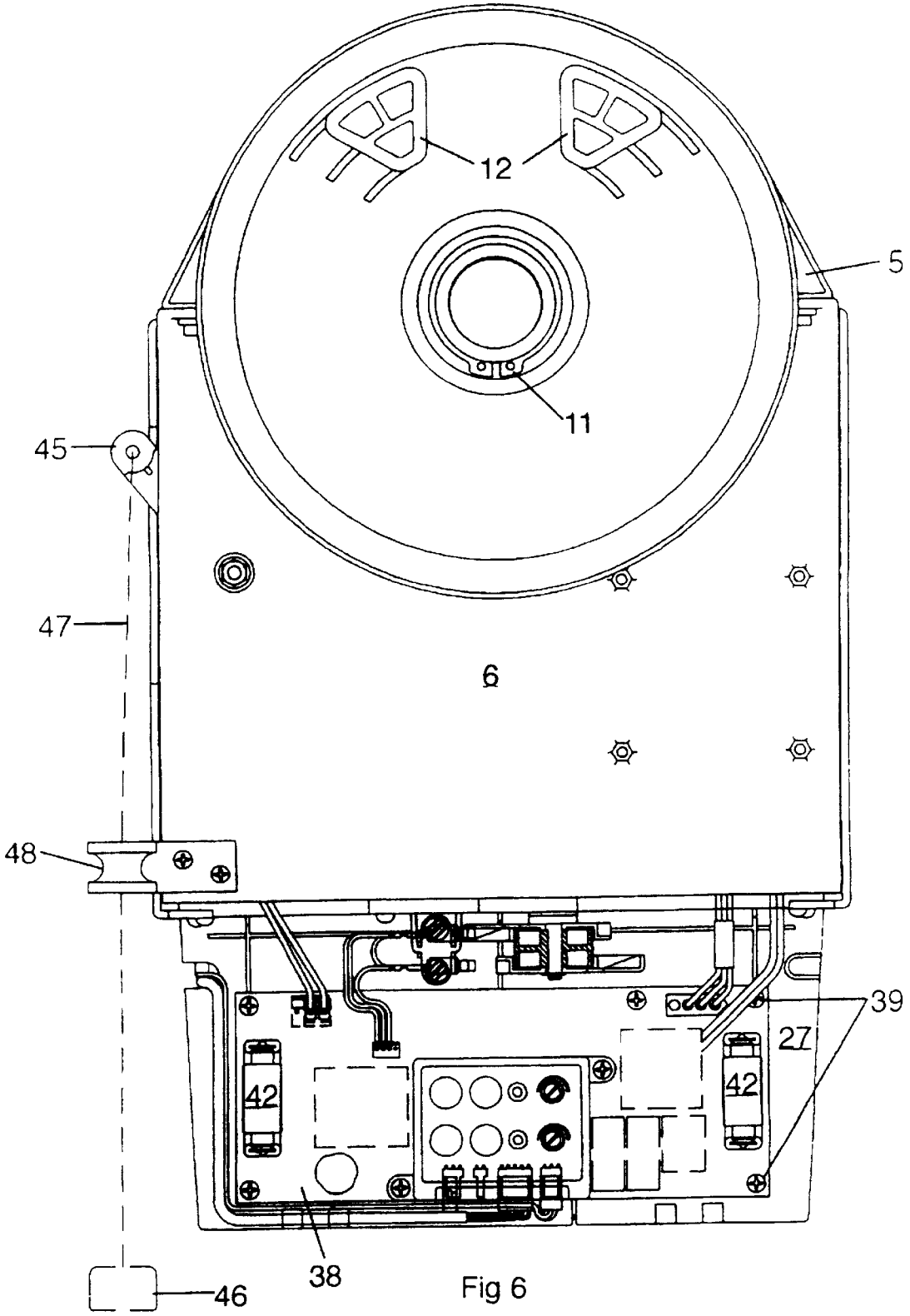
FIG. 6 is a front view of the assembly of FIG. 1 with the translucent cover removed.

A third section 27 (mote clearly shown in FIG. 4) is removably attached to second section 6 by screws 28. As shown in FIG. 6 third section 27 supports circuit board 38 via locating screws 39. The circuit board 38 carries the electronic circuitry necessary to permit the operation of the drive assembly 1 by a remote manual operator 40 and/or by a remote control device (not shown) interacting with the circuitry via aerial 41. Circuit board 38 also carries courtesy lights 42.

Figure 4:
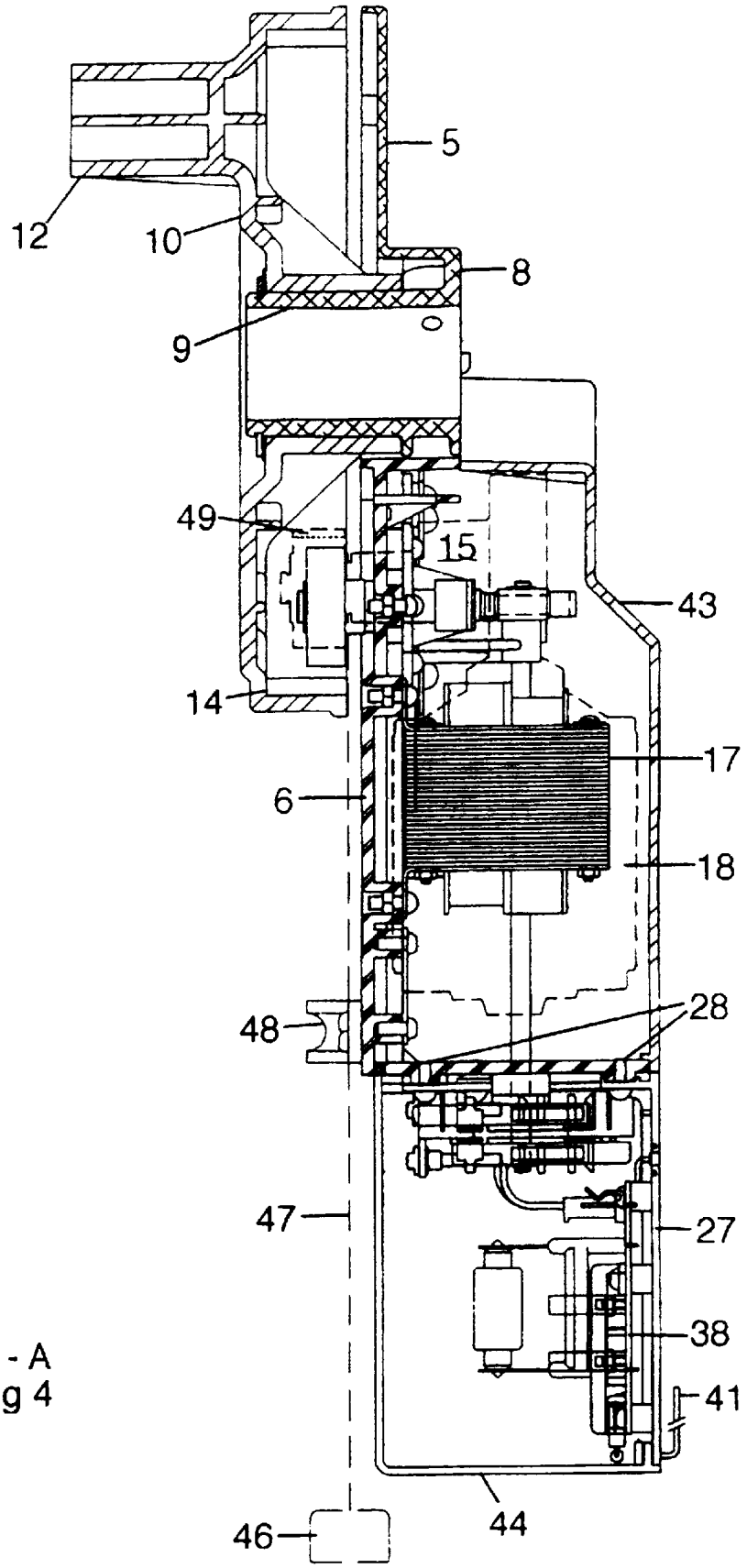
FIG. 4 is a sectional view of the assembly of FIG. 2 along the A—A line.

The elements supported on second section 6 can be protected by installing a main cover 43 as more clearly shown in FIG. 4. Likewise a translucent cover 44 encloses the circuit board 38, lights 42 and other circuitry.

The operation of cam ratchet assembly 19 to effect pivotal movement of the drive gear 15 into and out of engagement with gear drum 10 is shown more specifically in FIGS. 7–17.

In FIG. 7 drive gear 15 has cog teeth 49 which are engaged in teeth 14 of gear drum 10. These teeth are urged to intermesh under the influence of biasing spring 50 which is interposed between mounts 51 and 52. When motor 18 is activated cog teeth 49 are driven which in turn drives teeth 14 of gear drum 10. The rolling door 13 can be raised or lowered by motor 18.

In FIG. 9 cog teeth 49 of drive gear 15 are disengaged from teeth 14 of gear drum 10. This permits gear drum 10 to rotate without any influence from motor 18 or from the friction caused by interengaged teeth. Consequently the rolling door 13 may be raised or lowered manually.

Figure 12:
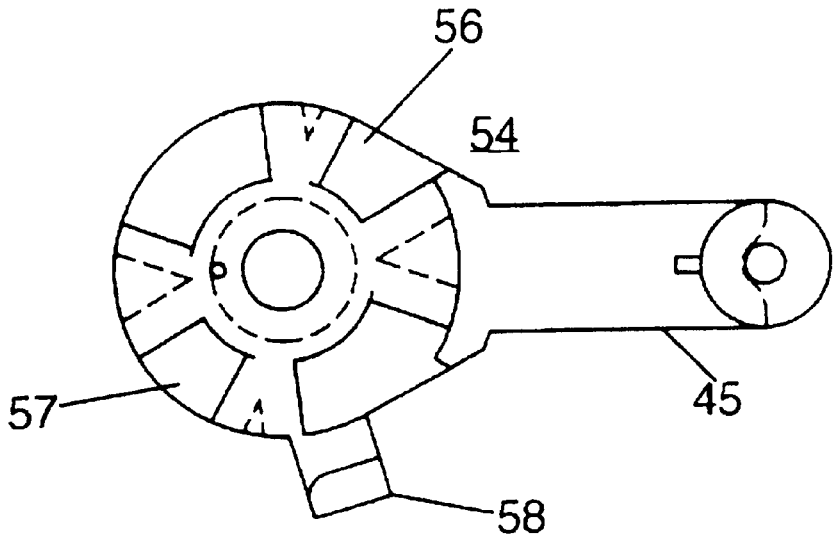
FIG. 12 is an underneath view of the pawl of FIG. 11.
Figure 11:
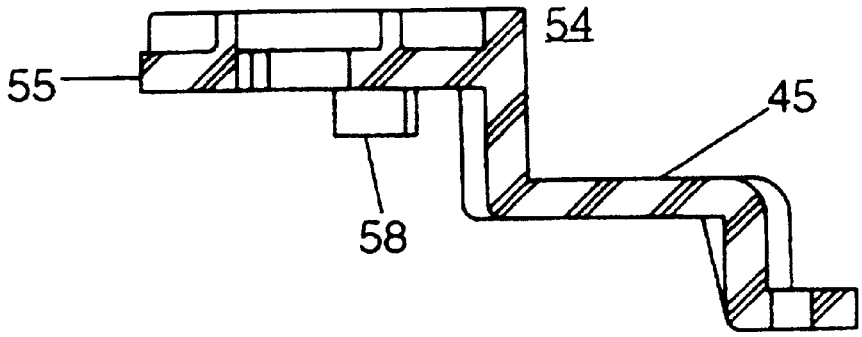
FIG. 11 is a cross-sectional view of a pawl used in the assembly of FIG. 9.
Figure 13:
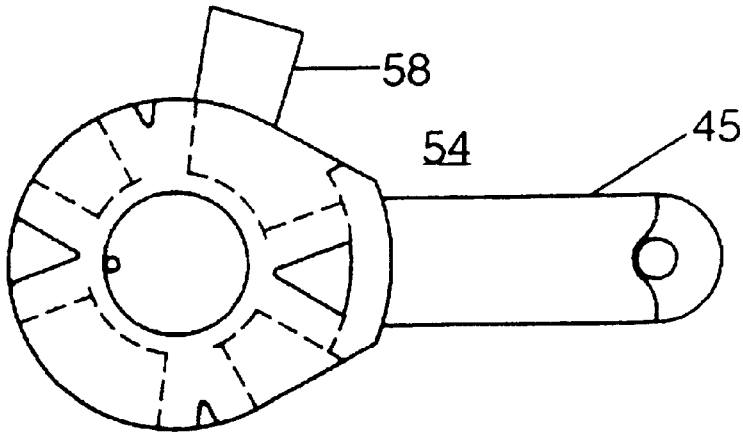
FIG. 13 is a plan view of the pawl of FIG. 11.
Figure 15:
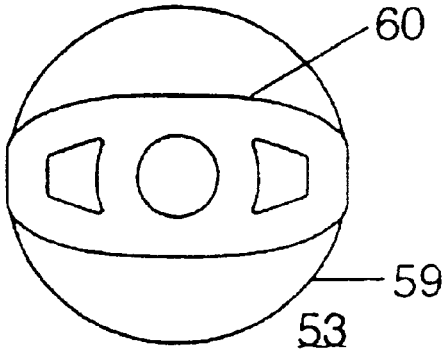
FIG. 15 is an underneath view of the wheel of FIG. 14.
Figure 16:
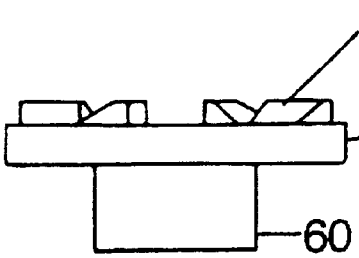
FIG. 16 is a side view of the wheel of FIG. 14.
Figure 14:
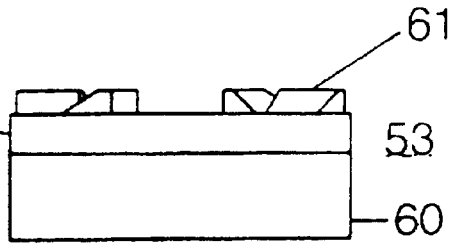
FIG. 14 is a side view of a wheel used in the assembly of FIG. 1.
Figure 17:
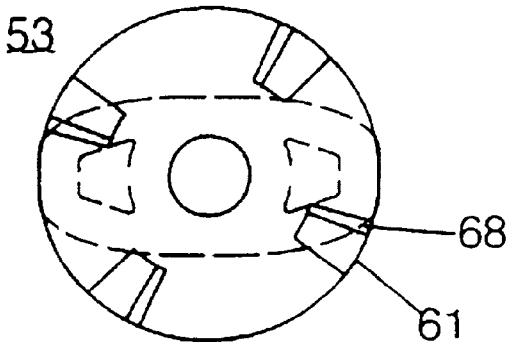
FIG. 17 is a plan view of the wheel of FIG. 14.

The movement of cog teeth 49 into or out of engagement with teeth 14 is controlled by cam ratchet assembly 19 as follows. The cam ratchet assembly 19 is composed of a wheel 53 as shown in FIGS. 14–17 which is engaged and turned by a pawl 54 as shown im FIGS. 12–13. Pawl 54 has the lever 45 at one end and an annular disc 55 at the other end. The annular disc 55 has two teeth 56 and 57 projecting downwardly as shown in FIG. 12. The annular disc 55 also has a spacer arm 58.

The wheel 53 as shown in FIGS. 14–17 has an annular base 59 and a cam 60 projecting from annular base 59. Ramped teeth 61 are located around the periphery of annular base 59.

Pawl 54 is placed over the top of wheel 53 so that teeth 56 and 57 engage between ramped teeth 61. As more clearly shown in FIGS. 8 and 10 a bolt 62 passes through pawl 54 and wheel 53 and second section 6. A spring 63 is located about bolt 62 and has an inner end 64 which locates in pawl 54. Spring 63 has an outer end 65 which is fixed to a U-shaped retaining plate 66 which surrounds the bead of bolt 62. Bolt 62 is held to second section 6 with a nut 67.

In use, as lever 45 is pulled downwardly by cord 47 teeth 56 and 57 of pawl 54 engage the upright face 68 of ramped teeth 61 causing wheel 53 and cam 60 to rotate. This downward movement causes rotation of retaining plate 66 which tensions spring 63. Release of cord 47 causes lever 45 to be returned to its original position under influence of spring 63. As the lever recoils it moves the teeth 56 and 57 of pawl 54 up and over ramped teeth 61 so that the recoil does not cause further movement of wheel 53 and cam 60.

As shown in FIG. 9 cam 60 has been rotated so that it engages frame 20 pivoting it anticlockwise about pivot bolt 21. This movement disengages cog teeth 49 from teeth of drive gear 15 from teeth 14 of gear drum 10.

As shown in FIG. 7 further movement of cam 60 by movement of lever 45 permits frame 20 to move in a clockwise direction about pivot bolt 21 under the influence of biasing spring 50. Biasing spring 50, as shown, is urging cog teeth 49 of drive gear 15 into a meshed relationship with teeth 14 of gear drum 10. A further movement of lever 45 downward causes cam 60 to reassume the position shown in FIG. 9 with a corresponding disengagement of the cog teeth 49 with teeth 14.

The drive assembly 1 described can be easily installed and maintained.

Installation may take place in basically two different ways. The first is to thread the entire assembly over mounting axle 2 via sleeve 9 and fix axle 2 to support bracket 3. The drive assembly 1 is fixed into the desired axial and radial positions by fixing locating bolts 16 through clamp 8 into engagement with mounting axle 2. However as these assemblies are usually very heavy an alternate installation method is permissible with the drive assembly according to the invention.

This method entails threading only the upper part of the drive assembly 1 onto axle 2. The upper part comprises the first section 5, and gear drum 10 which are held together by circlip 11 around sleeve 9. This upper part is fixed both axially and radially via locating bolts 16 passing through clamp 8 into engagement with axle 2. Thereafter the lower part of drive assembly 1 may be installed by attaching it to the upper part with bolts 7. Some axial movement may be necessary to align the cog teeth of drive gear 15 with teeth 14 if they are installed in the engaged position. However installing the lower part when it is in the position shown in FIG. 9 avoids this requirement.

Maintenance of any of the elements of the drive assembly 1 can be achieved by removing bolts 7 and disengaging the lower part of the drive assembly from the upper part. Obviously if the gear drum 9 or first section 5 has been damaged, it would be necessary to disengage the mounting axle 2 from support bracket 3 to remove and replace the damaged part As the motor 18, transformer 17 and electronic circuitry are all located below the mounting axle 2, each may be replaced or maintained without removal of all of the other elements. This is achieved by removing the main cover 43 which gives direct access to the motor 18 and transformer 17. Likewise circuitry can be readily accessed by removal of the translucent cover 44. Alternatively third section 27 can be removed totally from second section 6 by removal of screws 28 if more major maintenance is required.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

The claims defining the invention are as follows:

1. A rolling door drive assembly including:

(i) a final drive unit for connection to a door, whereby the door may be rotated by the final drive unit about an axis to open and close the door, (ii) a motor, (iii) drive means between the final drive unit and the motor operatively engaged with the motor, (iv) one or more drive axes about which one or more components of the drive means rotate to transfer drive from the motor to the final drive unit, (v) actuation means to bring the drive means to a first configuration at which the motor is engaged to drive the final drive unit through the drive means and to bring the drive means to a second configuration at which the motor is disengaged from driving the final drive unit, and (vi) resilient means for urging the drive means into one of the configurations, wherein the actuation means includes a cam rotatable about a cam axis separate from the one or more the drive axes, the cam acting to set the desired configuration of drive means.

2. The assembly according to claim 1 wherein the motor and drive means are both attached to a chassis for pivotally moving the motor and drive means between said first and second configurations.

3. The assembly according to claim 1 wherein the resilient means comprise a spring arranged to urge at least two components of the assembly into driving engagement so that the drive means assumes the first configuration and driving teeth on one of the components mesh with complementary teeth on the other of the two components.

4. The assembly of claim 1 wherein the actuation means comprises:

(i) a cam rotatable about a central axis;

(ii) a wheel fixed for rotation with the cam;

(iii) a pawl fixed for rotation about the central axis and selectively engaging the wheel;

(iv) means to rotate the pawl; and (v) resilient means to bias the motor and drive means towards the cam.

5. The assembly of claim 4 wherein the pawl is fixed for reciprocal rotational movement through a predetermined arcuate distance.

6. The assembly of claim 2 wherein the chassis has a first section having a clamp means for receiving a mounting axle and a second section detachable from the first section.

7. The assembly of claim 6 wherein the clamp means has fixing means to locate the first section in a predetermined position on the mounting axle.

8. The assembly of claim 7 wherein the fixing means is at least two location bolts engaged with the mounting axle.

9. The assembly of claim 6 wherein the chassis comprises a third section detachable from the first section and second section.

10. The assembly of claim 6 further comprising a frame on which the motor may be mounted, wherein the frame is pivotally attached to the second section.

11. The assembly of claim 1 further comprising electrical control means to control the operation of the motor.

12. The assembly of claim 11 wherein the electrical control means is mounted on the second and third sections.

13. The assembly of claim 1 further comprising a light.

14. The assembly of claim 1 further comprising at least one housing to enclose at least a part of the assembly.

15. The assembly of claim 11 wherein the electrical control means is mounted on the second section.

16. The assembly of claim 11 wherein the electrical control means is mounted on the third section.

* * * * *